US009728318B2

(12) United States Patent
Ismodes Cascon et al.

(10) Patent No.: US 9,728,318 B2
(45) Date of Patent: Aug. 8, 2017

(54) DRUM-TYPE TRI-PHASE TRANSFORMER AND METHODS FOR PRODUCING SAME

(71) Applicant: PONTIFICIA UNIVERSIDAD CATOLICA DEL PERU, San Miguel, Lima (PE)

(72) Inventors: Anibal Eduardo Ismodes Cascon, Lima (PE); Oscar Antonio Melgarejo Ponte, Lima (PE)

(73) Assignee: Pontificia Universidad Catolica del Peru, Lima (PE)

( * ) Notice: Subject to any disclaimer, the term of this patent is extended or adjusted under 35 U.S.C. 154(b) by 0 days.

(21) Appl. No.: 14/406,327

(22) PCT Filed: Nov. 13, 2012

(86) PCT No.: PCT/PE2012/000008

§ 371 (c)(1),
(2) Date: Dec. 8, 2014

(87) PCT Pub. No.: WO2013/184008

PCT Pub. Date: Dec. 12, 2013

(65) Prior Publication Data

US 2015/0162123 A1 Jun. 11, 2015

(30) Foreign Application Priority Data

Jun. 8, 2012 (PE) ..... 00806-2012/DIN

(51) Int. Cl.
*H01F 30/12* (2006.01)
*H01F 27/28* (2006.01)
(Continued)

(52) U.S. Cl.
CPC ..... *H01F 27/28* (2013.01); *H01F 27/245* (2013.01); *H01F 30/12* (2013.01);
(Continued)

(58) Field of Classification Search
CPC ..... H01F 27/28; H01F 27/245; H01F 30/12; H01F 41/0233
(Continued)

(56) References Cited

U.S. PATENT DOCUMENTS 1,716,553 A * 6/1929 Higbee ..... H01F 29/10 336/119
5,317,299 A * 5/1994 Dhyanchand ..... H01F 30/12 307/13

(Continued)

*Primary Examiner* — Elvin G Enad
*Assistant Examiner* — Kazi Hossain
(74) *Attorney, Agent, or Firm* — Michael J. Brown

(57) ABSTRACT

This new type of transformer comprises a ferromagnetic drum-type core characterized in that the drum core has a plurality of holes or windows parallel to the drum longitudinal shaft to place the windings being the windows arranged close to the periphery of the drum symmetrically distributed at 360° of the circumference, each winding being parallel to the longitudinal shaft of the drum and each one of the windings crossing said longitudinal shaft. The core comprises two main components: a central body and an air gap filling system. The central body is formed by a plurality of silicon steel sheets, stacked one over the other, each of them has slots or spaces on its periphery thereof to place the windings and with an air gap filling system. Said filling system can be: wedge-shaped sheets, set of sheets extending parallel to the shaft of the core or a metal sheet wound around the central body.

23 Claims, 13 Drawing Sheets

(51) Int. Cl.
*H01F 17/04* (2006.01)
*H01F 27/245* (2006.01)
*H01F 41/02* (2006.01)
*H01F 41/06* (2016.01)

(52) U.S. Cl.
CPC ..... *H01F 41/0233* (2013.01); *H01F 41/06* (2013.01); *Y10T 29/49071* (2015.01)

(58) Field of Classification Search
USPC ..... 336/12, 5, 170, 221
See application file for complete search history.

(56) References Cited

U.S. PATENT DOCUMENTS

| | | | | |
|---|---|---|---|---|
| 8,836,462 | B2 * | 9/2014 | Curiac | H01F 30/14 336/170 |
| 2002/0084712 | A1 * | 7/2002 | Hyun | H02K 17/16 310/179 |
| 2007/0145959 | A1 * | 6/2007 | Hyun | H02K 1/16 323/250 |
| 2009/0058584 | A1 * | 3/2009 | Rastogi | H01F 27/24 336/5 |

* cited by examiner

*Exploded view of rotor motor with rings*

DRUM-TYPE TRI-PHASE TRANSFORMER AND METHODS FOR PRODUCING SAME

1. FIELD OF THE INVENTION

This invention consists of a three-phase current and voltage transformer useful for the transmission and distribution of electrical supply as well as construction procedures.

2.STATE OF THE ART 2.1 Theory of Transformers 2.1.1 Transformer Equations (Simplified Form)

For the construction of transformers, it is necessary to resort to two of Maxwell's four equations and combine them with an array of ferromagnetic material that includes windows or empty spaces that accommodate the windings of the transformer.

In its most common form, required two equations are also known as the Faraday's law and Ampere's law, which in its simplified form of a transformer are:

Faraday's law: $E=4.44\,f.N.\phi_{max}$

Ampere's law: $N.I_O=(\phi_{max}/\sqrt{2}).\mathrm{Req}_{fe}$

Where:

E=effective induced voltage in a coil by the variation of sinusoidal magnetic flux.

f=frequency of the voltage applied to the coil source.

N=number of turns of the coil subjected to a variation of magnetic flux.

$\phi_{max}$=maximum value of magnetic flux flowing through the coil.

$I_O$=efficient value of vacuum or magnetization power that generates the magnetic flux.

$\mathrm{Req}_{fe}$=equivalent reluctance of iron for the magnetic circuit of closed loop through which circulates the magnetic flux.

2.1.2 Equivalent Circuit by Transformer Phase

Each phase of the transformer, including elements of the primary and secondary winding can be represented by an electrical circuit powered by an effective voltage V1 and formed by the set of impedances shown in FIG. 26.

Where the reference in FIG. 26 are:

$R_1$ represents the resistance of the primary winding of the transformer.

$X_{d1}$ represents the reactance due to dispersion flow concatenated with the primary winding of the transformer.

$R_{fe}$ represents the resistance of total losses in the core.

$X_m$ represents the magnetizing reactance.

$R_2$ represents the resistance of the secondary winding.

$X_{d2}$ represents the reactance due to dispersion flow concatenated with the secondary winding of the transformer.

$Z_c\angle\phi$ represents the impedance of the load of the transformer.

In addition:

$I_1$=line current $I_0$=magnetizing current $V_1$=the supply voltage (input voltage at primary)

$E_1$=induced e.m.f. at primary $V_2$=voltage in the transformer load $I_2$=current at the secondary $E_2$=induced e.m.f. at secondary $$E_1=4.44N_1f\phi_m$$

$$E_2=4.44N_2f\phi_m$$

Where it is demonstrated that: $E_1/E_2=N_1/N_2$

Quite roughly, in power transformers, it is demonstrated that:

$$V_1/V_2=N_1/N_2$$

In addition, in power and distribution transformers, it is demonstrated that:

$I_0$=magnetizing current varies between 0.6-5% of the I nominal, being I nominal the maximum current that can circulate regularly and permanently by an electric machine without damaging it.

2.2 State of the Art 2.2.1 Power or Distribution Transformers:

Nowadays, the most used three-phase transformer for electrical supply transmission is the transformer with a three-leg core as shown in the FIG. 1.

The transformer is manufactured by placing in each leg of the core, a primary winding and a secondary winding. The three primary windings are connected among themselves in delta connection or star connection, a primary three-phase voltage is applied to them and a secondary three-phase voltage is generated in each of the secondary windings.

The three secondary windings are also connected in star connection or delta connection, according to the requirements of the corresponding load.

This transformer has several decades of existence. The FIG. 2 shows the external appearance of the legged-three-phase transformer.

The inner core is usually built of overlapping ferromagnetic sheets as shown in the FIG. 3.

In recent decades, the main improvement in the manufacture of transformers has been oriented to the development of new ferromagnetic materials to the construction of the core, but retaining the leg shape, as shown in the FIG. 4.

Most progress that has been achieved is a ferrite core with three rings of square shape that, properly placed, form three legs arranged symmetrically, as shown in the FIG. 5. These cores can be manufactured to date, for less than 5 MVA power transformers.

Likewise, the transformer of FIG. 6 has also a symmetric core, but the areas enclosed by the windings A, B, C are relatively thin and more winding than is needed for a given power capacity will be needed.

Some patent documents relating to the invention can be found at the following links:

U.S. Pat. No. 6,683,524: http://www.freepatentsonline-.com/6683524.pdf

U.S. Pat. No. 4,357,587: http://www.freepatentsonline-.com/4357587.pdf

U.S. Pat. No. 1,380,983: http://www.freepatentsonline-.com/1380983.pdf

U.S. Pat. No. 1,783,063: http://www.freepatentsonline-.com/1783063.pdf

Bibliography for the manufacture of the legged-three-phase transformers is quite wide and the most remarkable book of Enrique Ras is: *Transformadores de potencia, de medida y de protección* (Power, measuring and protection transformers) (Alfaomega Marcombo 7$^{th}$ Edition, 1995).

Wound-rotor Asynchronous Machine

Although it was designed for another purpose, it may be considered that wound rotor induction motors can be considered as background of the three-phase transformer of the drum type. More than 100 years ago, Nikola Tesla developed asynchronous or induction motor. At present, after decades of development and improvement three-phase induction motor is built for the most part, according to what is known as the rotor squirrel cage. It is the electric motor that is used to convert electrical supply into mechanical energy. On a much smaller scale, asynchronous or wound rotor induction motor is also built. In this type of wound rotor motor, coils of the rotor by means of seal rings communicate to the outside of the rotor and the rotational speed of the rotor can be controlled using impedances.

The FIG. 7 shows the cutting of a wound rotor asynchronous motor.

The stator is a set of three three-phase windings connected to an external source of three-phase voltage.

In the rotor are also inserted three three-phase windings, with an equal distribution to the stator. Both rotor and stator are built by stacking ferromagnetic sheets (silicon steel) as shown in the FIG. 8.

It is known that, if the rotor windings are fixed with respect to the stator and if three-phase voltage is applied to the primary circuit or stator windings, secondary windings show an equal voltage to the applied voltage to the primary and multiplied by the ratio of turns between secondary winding and primary winding; therefore, it results the voltage transformation which is equal to any three-phase transformer.

However, since this type of engine has a significant air gap, it has not an industrial applicable use as a three-phase transformer due to the high magnetizing current.

If we refer to the equivalent circuit shown in Section 2.1.2, the air gap causes, for an equivalent power, the Xm value in induction motor is around 10 times lower than the value of a similar power transformer. That causes that the abovementioned magnetizing current is excessive and becomes inconvenient to use the wound rotor asynchronous motor as a transformer.

Thus, the use of wound rotor motors as variable voltage sources (using the principle of transformer), has fallen into disuse mainly due to the low efficiency because of the air gap.

Despite there are many types of transformers, none of the prior art devices abovementioned has an optimal relationship between capacity and weight of the core for a specific power. In other words, they are larger and heavier than necessary, impacting it in the amount of materials used in their manufacture and in the cost.

The first purpose of this invention is to make transformers more compact, reducing the size of the core for a same capacity of power conversion.

The second purpose of this invention is to describe manufacturing methods to construct various forms to develop the invention.

3. BRIEF DESCRIPTION OF THE INVENTION

This new type of transformer comprises a ferromagnetic drum-type core characterized because the drum core has a plurality of holes or windows parallel to the drum longitudinal shaft to place the windings being the windows placed near the periphery of the drum symmetrically distributed at 360° of the circle, while each of the transformer coil parallel to the longitudinal shaft of the drum and drum crossing each of windings of the longitudinal shaft. As used herein, "longitudinal shaft" refers to a reference line at the central axis of the drum-type core, extending through the center of the drum-type core, but is not a physical part of the drum-type core.

The core comprises two main components:

A central body, and an air gap filling system

Where the central body is formed by a plurality of silicon steel sheets, stacked one over the other, each of them has slots or space on its periphery to place the windings and with air gap filling systems of slots or space. This core can be made on four constructive different modalities in each type of development of the transformer as described below.

It can also be a constructive mode where the core is only made of stacked sheets and where the sheets have windows instead of slots. In this constructive mode, transformer winding is handcrafted.

In a first type of development of the transformer, there are six slots or windows that extend in parallel to the longitudinal shaft of the drum and the primary winding and the secondary winding of each phase are placed in the same window, that is, the secondary roll is on the primary winding roll, so that there is no gap between the primary coil and secondary coil in each phase of the transformer.

In a second type of development of the transformer, there are twelve slots or windows that extend in parallel to the longitudinal shaft of the drum and the primary winding and the secondary winding are placed in a different pair of slots or windows, so that the secondary windings have 30° phase change regarding the primary windings in each phase of the transformer.

4. BRIEF DESCRIPTION OF DRAWINGS

FIG. 1: Diagram of a typical three-phase transformer.

FIG. 2: Three-phase distribution transformer. Reference: http://www.directindustry.com/prod/silveratech/three-phase-choke-coils-63641-469122.html.

FIG. 3: A constructive way of using silicon steel sheets which is built the majority of three-phase transformer cores. Reference: http://tromag.es/product.php?id_product=13.

FIG. 4: Ferrite core /three-phase transformers. Reference: http://detail.en.china.cn/provide/detail,1025354170.html.

FIG. 5: Latest core for three-phase transformer, with the more symmetrical arrangement reached so far. Reference: http://img.en.china.cn/0/0,0,402,1691,309,488, cfbe5fe4.jpg.

FIG. 6: Three-phase transformer core. Reference: European Patent EP0078908.

FIG. 7: Spare part drawing of wound rotor asynchronous motor or wound rotor induction motor. Reference: http://www.ikkaro.com/files/despiece-motor-rotor-anillos.jpg.

FIG. 8: Silicon steel sheets to build the stator and wound rotor induction motors or asynchronous motors. The windings are inserted into the empty spaces. Reference: http://tromag.es/product.php?id_product=47.

FIG. 9: Cross section of the magnetic core (10) of a drum-type three-phase transformer with six windows, each one (13) extends in parallel to the longitudinal shaft of the core, so that primary (11) and secondary (12) windings of each phase are in the same space. First type.

FIG. 10: Cross (left) and longitudinal (right) sections of the drum-type three-phase transformer core of the transformer of FIG. 9, with line a-a' representing a referential element of a longitudinal shaft or central axis of the transformer core.

FIG. 11: There is a model of the first type of the transformer characterized by a central core (20) composed of thin silicon steel sheets stacked one against the other, each one of them with six trapezoidal slots placed on the edges. The slots (also called windows) contain primary and (21) secondary (22) windings of each phase. Each slot (23) has a trapezoidal sheet (24) that fits therein so that it closes the circuit for magnetic flux. The figure on the left exemplifies the insertion form of the ferromagnetic material filling a slot; the figure on the right shows the transformer with all filled slots.

FIG. 12: It shows the air gap filling with insertion of a ferromagnetic material in the openings facilitating thus winding for the first type. The core comprises a central body (30) and an air gap filling system (34), each of the sheets of the central body has six trapezoidal spaces (33), each one of them communicates through a slot (30*a*) with the outside; and the air gap filling consists of six sets (34) of sheets (34*a*) that extend in parallel to the longitudinal shaft and fit in the slots once the circular sheets of the central body are stacked, and this closes the circuit for magnetic flux. Likewise, primary and (31) secondary (32) windings of each phase are placed in the same pair of slots. The figure on the left exemplifies the insertion mode of ferromagnetic material, the figure on the right shows the transformer with all windows closed.

FIG. 13: Fourth constructive mode of central body (40), where the air gap filling consists of a sheet rolled (44) around the central body. Likewise, primary (41) and secondary (42) windings are placed in a same window of the transformer.

FIG. 14: Diagram of construction procedure of transformer of first type, second mode. Step a) shows primary winding (21), step b) shows secondary winding (22) of the same phase, step c) shows the placement of air gap filling system (24), and FIG. 14 d) shows the transformer kept in FIG. 11, already constructed.

FIG. 15: Shows a second type of transformer core (50) with twelve slots or windows that extend in parallel to the longitudinal shaft. Likewise, primary winding (51) is placed in a window different from the window where the secondary winding (52) is placed.

FIG. 16: Second type of 12 windows with wedged air gap filling for each window (64). There is a central body (60) composed of several silicon steel sheets stacked one against the other, each of them has twelve trapezoidal slots (63) to place the primary (61) and secondary (62) windings, which are also placed in different slots.

FIG. 17: There is a model of the second type of 12 windows with sheet air gap filling. It is composed of the core comprising a central body (70) and an air gap filling system, where each of the steel sheets composing the central body has twelve trapezoidal slots (73) that communicate through a slot 70*a* with the outside; and air gap filling consists of twelve sets (74) of sheets (74*a*) that fit into the slots, once the circular sheets of the central body are stacked, and thus a circuit for magnetic flux is closed. Likewise, primary (71) and secondary (72) windings of each phase are placed in different spaces.

FIG. 18: Second type of 12 trapezoidal windows (83) made up from steel sheets composing the central body (80). The windows place primary (81) and secondary (82) windings in several locations, separated 30° among each other, and air gap filling consists of a sheet rolled (84) around the central body. It is remarkable to state that slots do not need to be deep (a difference that is not shown in the figures) as in the third mode since they do not need to place trapezoidal sheets.

FIG. 19: Diagram of windings, direction of rotation and numbering typical of the second type.

FIG. 20: First type, third mode. Front view of a prototype of transformer with flat strips of steel as air gap filling.

FIG. 21: First type, third mode. Longitudinal view of the prototype of the previous figure.

FIG. 22: Second type, second or fourth mode, front view of the prototype of the core with 12 slots. Each primary winding and secondary winding occupies two slots. There is a need of outer rolling of silicon steel sheets of the class shown in FIG. 13.

FIG. 23: Second type, second or fourth mode. Longitudinal view of the prototype of the core with 12 slots. Each primary winding and secondary winding occupies two slots. There is a need to place outer rolling of silicon steel sheets of the class shown in FIG. 13.

FIG. 24: Second type, fourth mode, front view of the prototype of the core with 12 slots. Each primary winding and secondary winding occupies two slots.

FIG. 25: Second type, fourth mode. Longitudinal view of the prototype of the core with 12slots. Each primary winding and secondary winding occupies two slots.

FIG. 26: Circuit diagram of equivalent circuit by transformer phase.

5. DETAILED DESCRIPTION OF THE INVENTION

As shown in FIGS. 9 to 25 the invention is a three-phase transformer for electrical supply transmission comprising a ferromagnetic, drum-type core where:

The core of the drum has holes or windows that extend in parallel to the longitudinal shaft of the drum The transformer has three pairs of windings, corresponding to the first, second and third phases, Each pair of windings consists of a primary winding and a secondary winding, The windings are symmetrically distributed around the longitudinal shaft of the core, while each winding is placed in a pair of windows or slots diametrically opposed and each winding crosses that longitudinal shaft.

In addition, the material of sheets to the central body can be: silicon steel or ferrite.

FIGS. 9 to 14 correspond to a first type of the core development, with six windows or slots to place the six coils and FIGS. 15 to 19 correspond to a second type of the core development, with twelve windows or slots to place the six coils.

In addition, for any of these two types, the core can be built from four different constructive modes.

In a first constructive mode, the core is made of stacked sheets where the sheets have windows instead of slots. This kind of core winding is handcrafted.

According to FIG. 9, the ferromagnetic core (10) with six windows (13) that extend in parallel to the longitudinal shaft of the core, where the primary winding (11) and secondary (12) of each phase are in the same place.

FIG. 10 shows the cross section of FIG. 9 where sheets are stacked one over the other.

Feeding the three primary windings with three-phase voltage generates a magnetic flux of a constant module which rotates at a constant speed, directly proportional to the frequency of the applied voltage.

The generated magnetic flux induces a voltage that complies with the Faraday's law. According to this law, the ratio of voltage between each of the primary and secondary circuit windings is equivalent to the ratio of the number of turns of the windings.

In a second constructive mode of the core (FIG. 11), the core includes two main components: a central body and an air gap filling system, Where the central body (20) is composed of several silicon steel sheets stacked one against the other, each of them has six trapezoidal slots (23) in the edge of the circle to place the windings, and the air gap filling system for each sheet consists of six ferromagnetic trapezoidal sheets (24) that fits on each circular sheet of the central body and close the circuit for magnetic flux. The primary (21) and secondary (22) windings of each phase are placed in the same slots. Instead of trapezoidal sheets can be otherwise, for example, rectangular. These elements could be removed previously from the same slots on each circular sheet of the central body.

The procedure to assemble this second mode can be one of the prior art, as drilling each sheet where fasteners, such as nuts, are used on the edges to be fixed.

Similarly, in a third constructive mode of the core (FIG. 12) the core comprises a central body (30) and an air gap filling system (34), each of the sheets of the central body has six trapezoidal spaces (33), each one of them communicates through a slot (30.*a*) each one of them communicates through a slot (30.*a*) with the outside; and the air gap filling consists of six sets (34) of sheets (34*a*) that extend in parallel to the longitudinal shaft and fit in the slots once the circular sheets of the central body are stacked, and this closes the circuit for magnetic flux. Likewise, primary and (31) secondary (32) windings of each phase are placed in the same pair of slots.

Finally, FIG. 13 describes a fourth constructive mode of the central body (40), where the sheets of the central body are identical to the second constructive mode (20), and both differ from the air gap filling which consists of a rolled sheet (44) around the central body. Also, the primary (41) and secondary (42) windings are placed in the same window. In addition, both differ from the slots which do not need to be so deep (difference is not shown in figures) as in the third mode since it is not needed to place trapezoidal sheets.

FIG. 14 shows the manufacturing process of a transformer for the first type, second mode. It is necessary to highlight that air gap filling system has been previously extracted from each circular sheet that makes up the central body. Step a) shows the primary winding (21), step b) the secondary winding (22) in the same phase, step c) installation of air gap filling system (24), and FIG. 14 d) shows the transformer of FIG. 11 manufactured.

FIGS. 15 to 19 describe the second type of the transformer core. This type has twelve windows that extend in parallel to the longitudinal shaft of the core and the primary winding and the secondary winding of each phase are placed in adjacent windows.

According to Ferraris method, it is possible to place the primary windings with 120° phase change each other (in separate slots) to get spaces to place the secondary windings.

In the second mode, the primary windings alternate with the secondary windings being the primary and secondary windings of each phase contiguous to each other and with 30° phase change. In this case, the voltage in the secondary windings will have 30° phase change regarding the voltage in the primary windings (due to the spatial 30° phase change).

Figure 1:
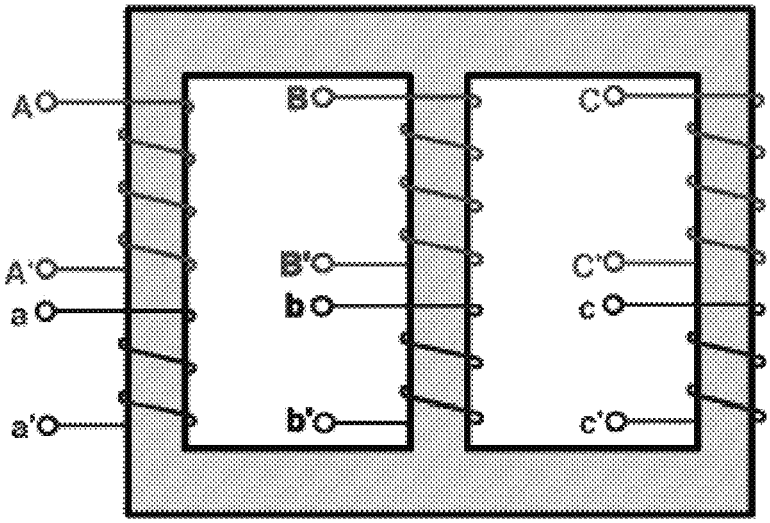
Figure 1. Prior Art

A central body (60) and an air gap filling system (64), where the central body (60) composed of several silicon steel sheets stacked one against the other, each of them has twelve trapezoidal slots (63) to place the primary (61) and secondary (62) windings, which are also placed in different slots. The air gap filling consists of twelve ferromagnetic elements has twelve trapezoidal slots (64) that fit into the trapezoidal slots, once sheets are stacked, and thus close the circuit for magnetic flux. Instead of trapezoidal sheets can be otherwise, for example, rectangular.

Also, as in the first type, second mode, fasteners can be used to assemble the whole, technique already known in the state of the art.

Figure 17:
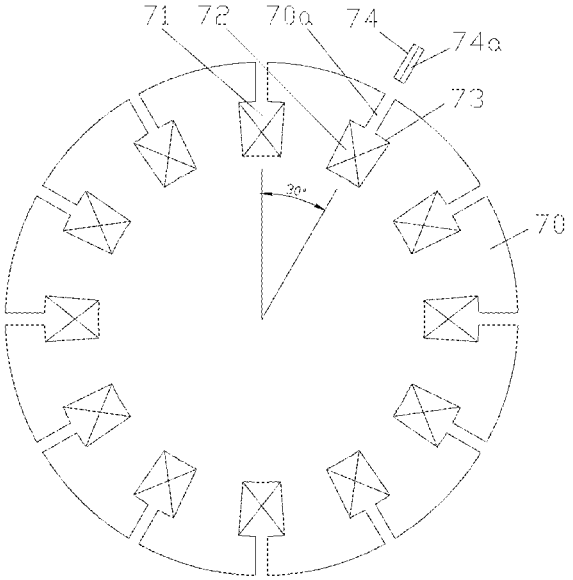

FIG. 17 shows a third mode for the second type where the core comprises a central body and an air gap filling system, where each of the sheets that make up the central body (70) has twelve trapezoidal spaces (73) each one of them communicates through a slot 70*a* with the outside; and air gap filling consists of twelve sets (74) of sheets (74*a*) that fit into the slots, once the circular sheets of the central body are stacked, and thus a circuit for magnetic flux is closed. Likewise, primary (71) and secondary (72) windings of each phase are placed in different spaces.

Figure 18:
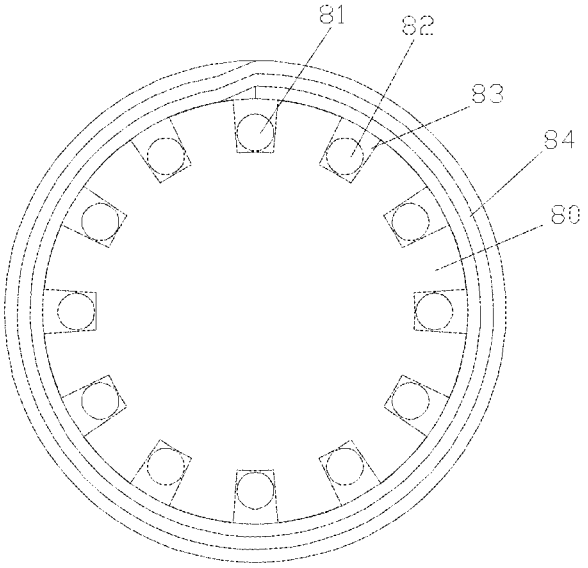

Finally, FIG. 18 shows a fourth mode for the second type of twelve trapezoidal slots (83) or spaces made up from steel sheets composing the central body (80) where primary (81) and secondary (82) windings are placed in different windows, separated 30° among each other, and air gap filling consists of a sheet rolled (84) around the central body. In addition, slots do not need to be deep (a difference that is not shown in the figures) as in the third mode since they do not need to place trapezoidal sheets.

Figure 19:
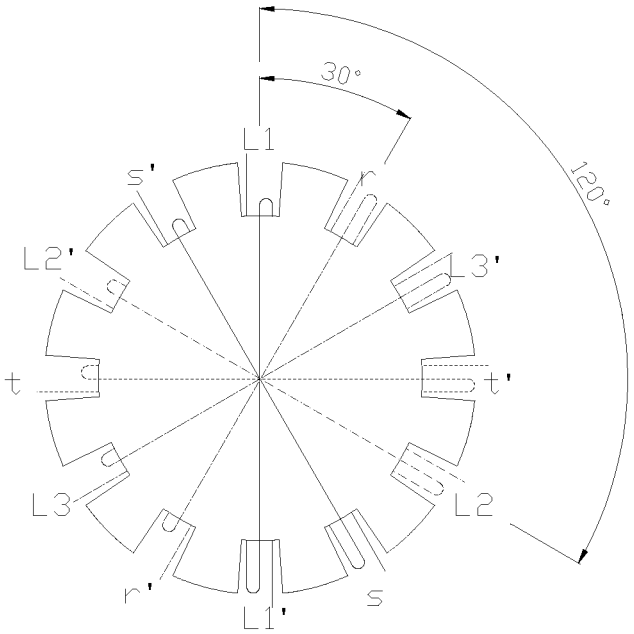
Figure 20:
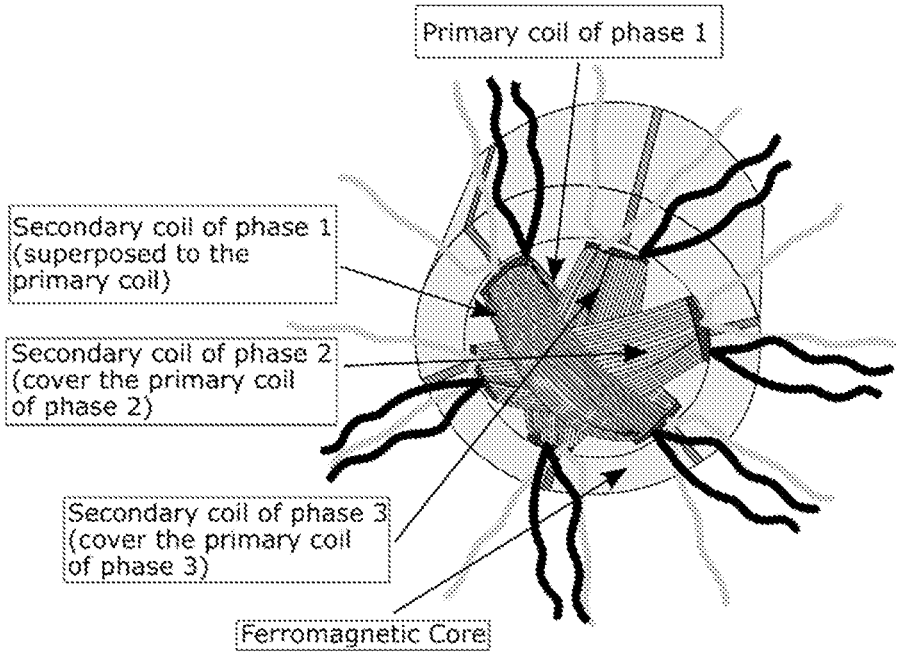

FIGS. 19 and 20 show a prototype for the first type, third mode, with ferromagnetic core and the corresponding windings that make up the transformer. In this prototype, the primary winding and secondary winding from each of the three phases are overlapping.

Figure 22:
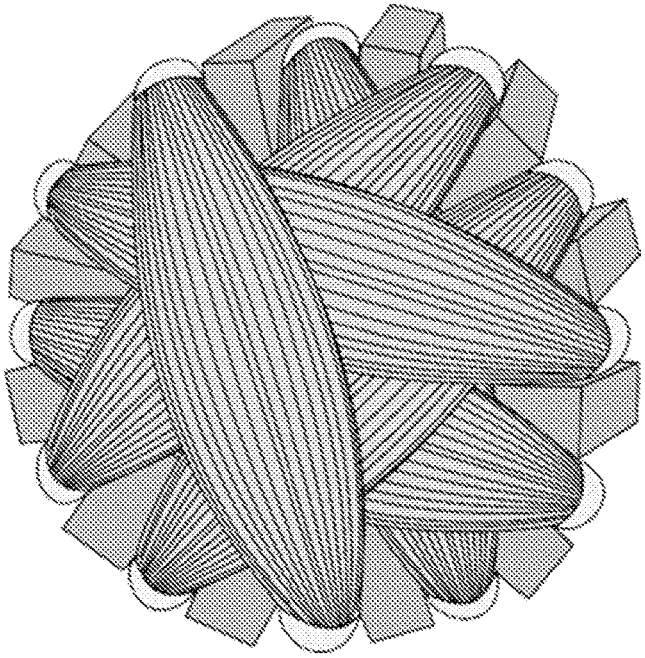
Figure 23:
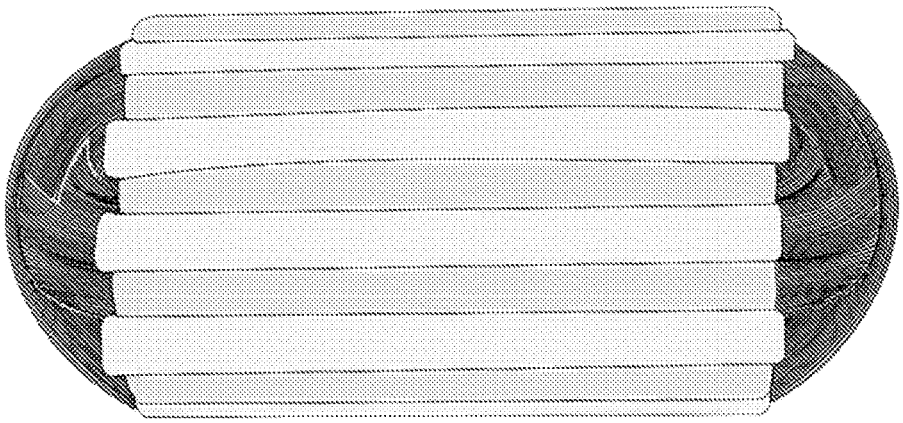

FIGS. 22 and 23 show a prototype for the second type, fourth mode, which show the twelve slots, coils and the air gap filling system. In this prototype, the primary and secondary windings of each phase are in different slots.

Figure 24:
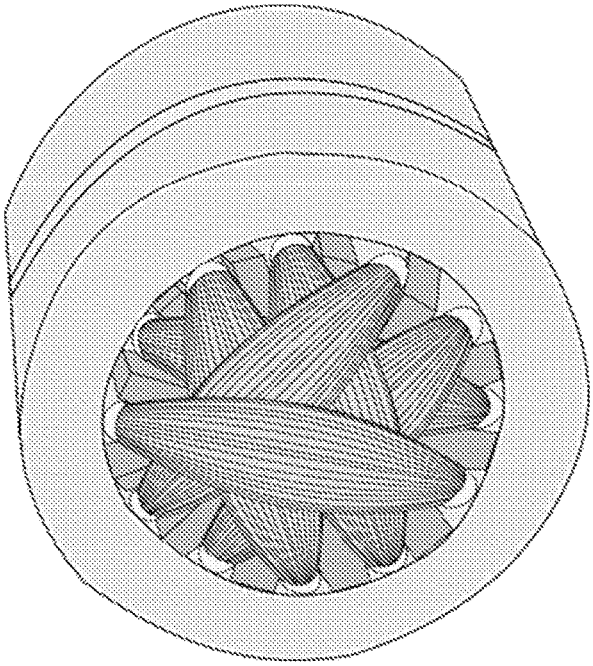
Figure 25:
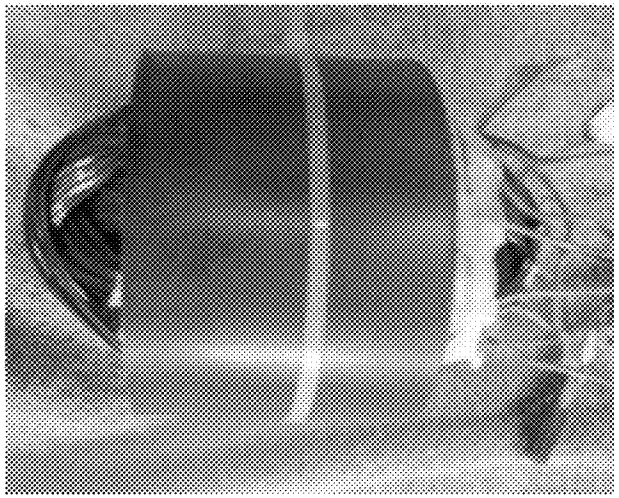
Figure 26:
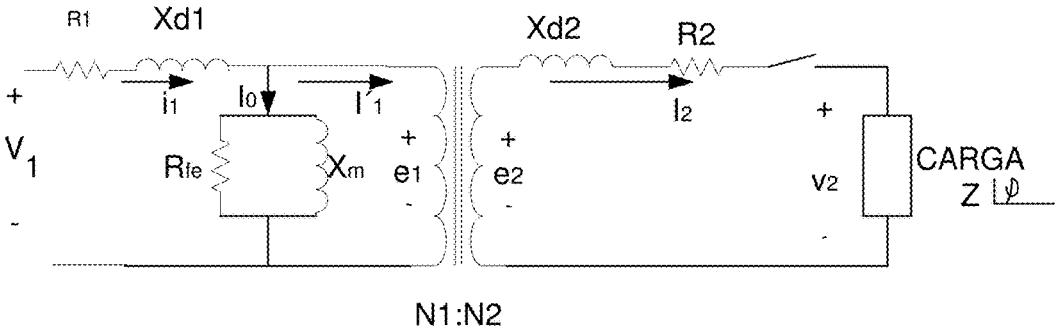

FIGS. 24 and 25 show a prototype for the second type, fourth mode, which shows the previous prototype, but with the air gap filling system installed.

6. MANUFACTURING PROCEDURES

Figure 9:
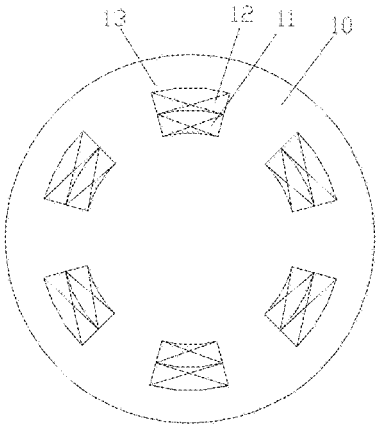
Figure 10:
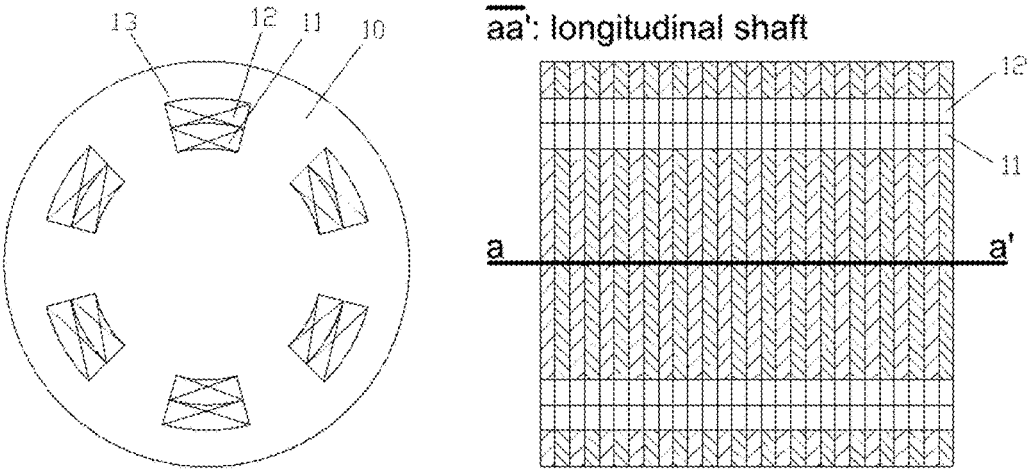
Figure 11:
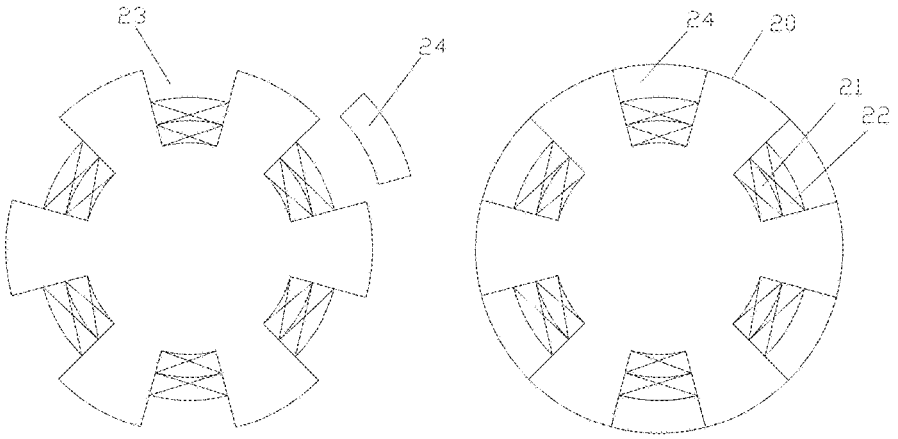
Figure 12:
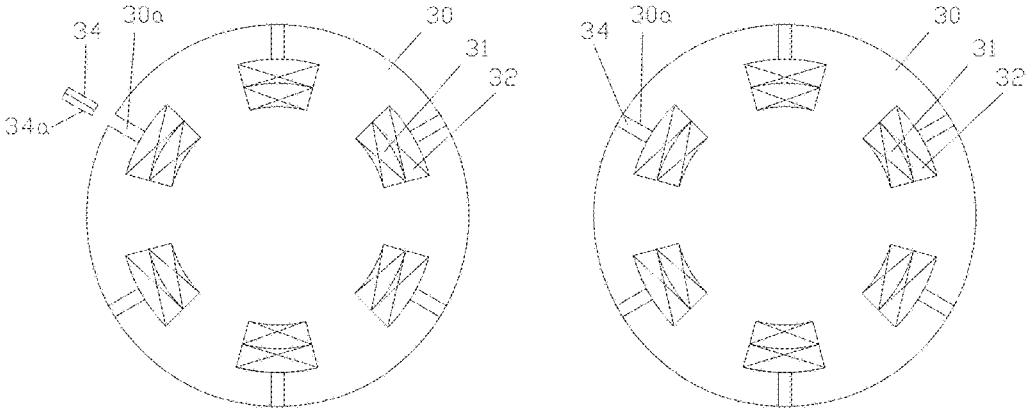

As shown in FIG. 9, first type, first mode, the core manufacturing procedure comprises the manufacture of trapezoidal windows in each ferromagnetic sheet making up the core. Primary and secondary windings of the transformer shall be placed therein, rolled so that the windings can cross over the longitudinal shaft of the drum formed. The final aspect of the core is a cylinder or a drum.

In this first mode, the core winding might roll in a handcrafted manner when the primary and secondary windings need a few loops (first mode), but as long as winding turns exceed ten, it is impracticable to roll it in a handcrafted manner particularly in big transformers.

To solve this issue and in order to always fill or reduce to the minimum the air gap hindering magnetic flux circulation, this invention proposes that another core constructive modes, as the ones described in FIGS. 10 to 15 and 16 to 25, include:

1) Manufacture of a core from a central body and an air gap filling system,
2) Manufacture of a central body from sheets with slots or spaces stacked one against another,
3) Manufacture of air gap filling system
4) Transformer winding 5) Assembly of the central body and air gap closures to compose the core.

In the second, third and fourth modes; the ferromagnetic core is made openly, since slots were made to the circle of each sheet, which enables to insert appropriately the primary and second windings of the three phases.

Particularly in the second and third modes, upon inserting the windings, the air gaps formed in slots or spaces are closed with several ferromagnetic pieces in the form of sheets or plates, and these windows are built with already rolled windings, extending those windings throughout the longitudinal shaft of the core. The second constructive mode of the core contains trapezoidal sheets and the third one contains plates grouped in each slot throughout the core shaft. These two modes, the second or third ones, apply to any of the two types of transformer.

Figure 13:
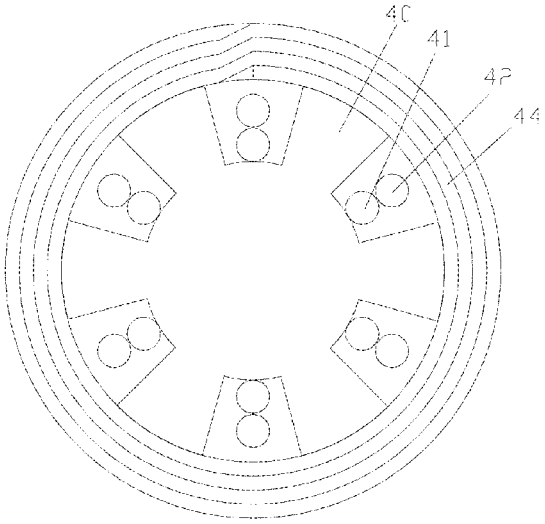
Figure 14:
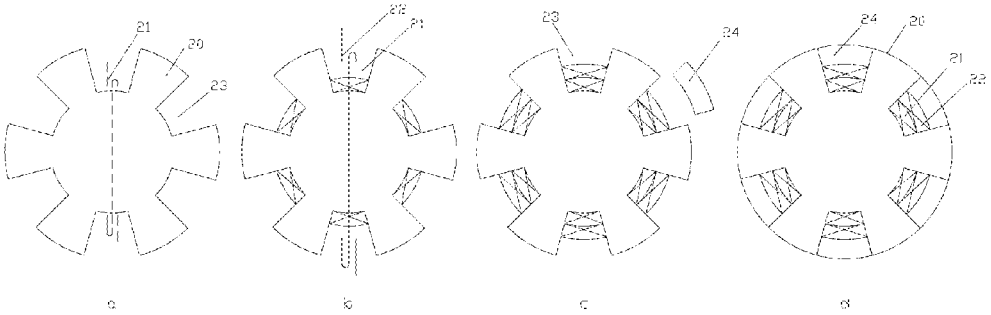
Figure 15:
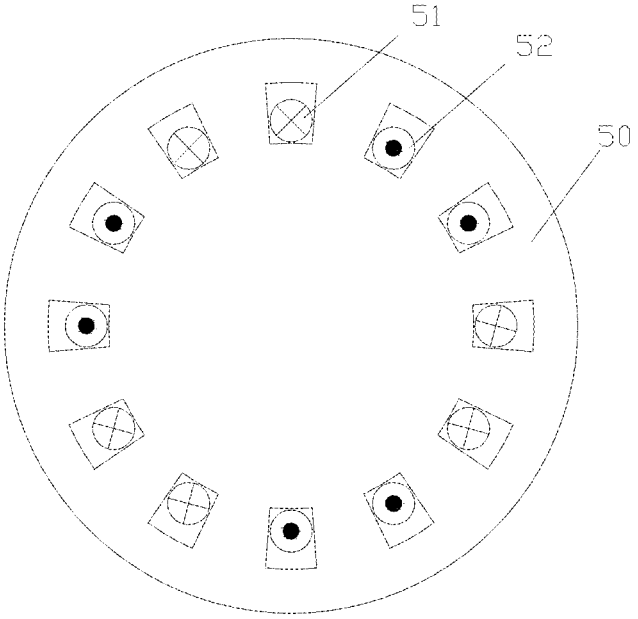
FIG. 15 shows a first constructive mode for the second type, where the core (50) has twelve windows that extend in parallel to the longitudinal shaft of the core, in which the primary winding (51) is placed in a different window from the window in which the secondary winding (52) is placed. This kind of winding core is handcrafted.
Figure 16:
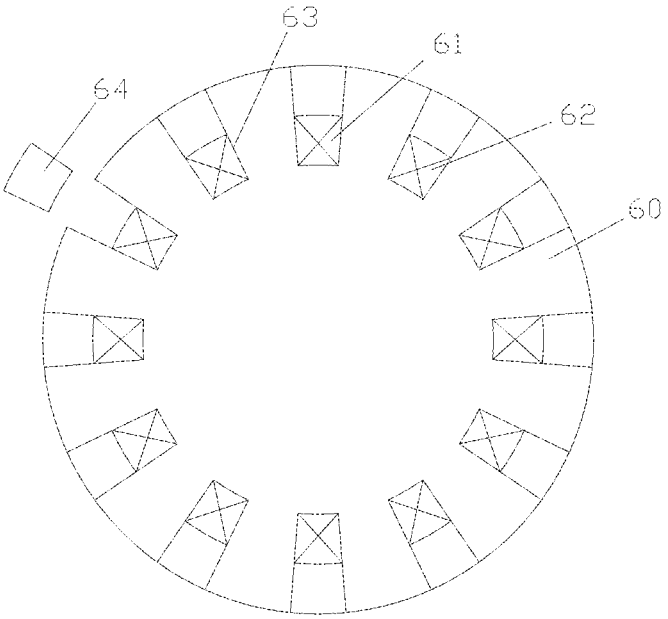
FIG. 16 shows a second constructive mode for the second type, where the core comprises two main components.

In the fourth mode, a ferromagnetic flat strip of steel is rolled around the central part of the core to fill the slots (FIG. 13).

These layout modes enable to construct three-phase transformers of any capacity since it is possible to construct the central core in two pieces.

In the second type, is the core is constructed with silicon steel sheets, both the central core and elements or pieces filling air gaps may be constructed of the same sheet.

These three alternatives may apply to both the core with six slots where the primary and secondary windings of each phase are in a slot of the first type such as the core where the primary and secondary windings are in different slots with a 30° gap between each other from the second type.

Sheets composing the core may be of silicon steel or ferrite in any of the two types.

There are other modes that a person turned in the matter can infer from reading the document, which are not described in the figures, such as that the air gap filling system might consist of a crown in the form of a ring placed around the slotted central body and in another mode, we can use an element in the form of a wedge in parallel to the core shaft to fill slots, however, those modes do not change the invention spirit.

Likewise, instead of six or twelve slots of the first or second type of the transformer, whatever number of slots multiple of six may be implemented, where more than six windings could be used, and thus the gap between each phase might be lesser.

7. INVENTION ADVANTAGES

Figure 2:
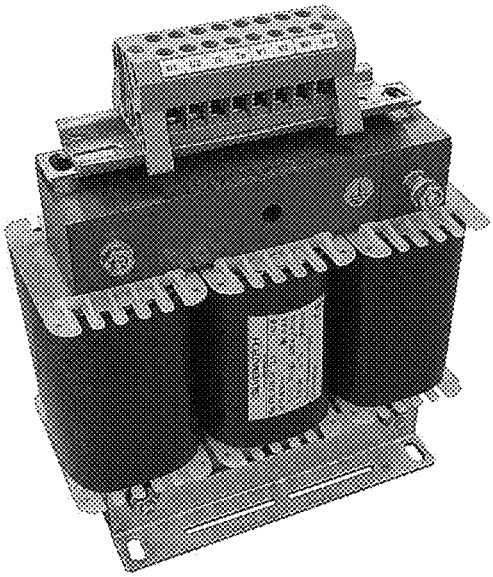
Figure 2. Prior Art
Figure 3:
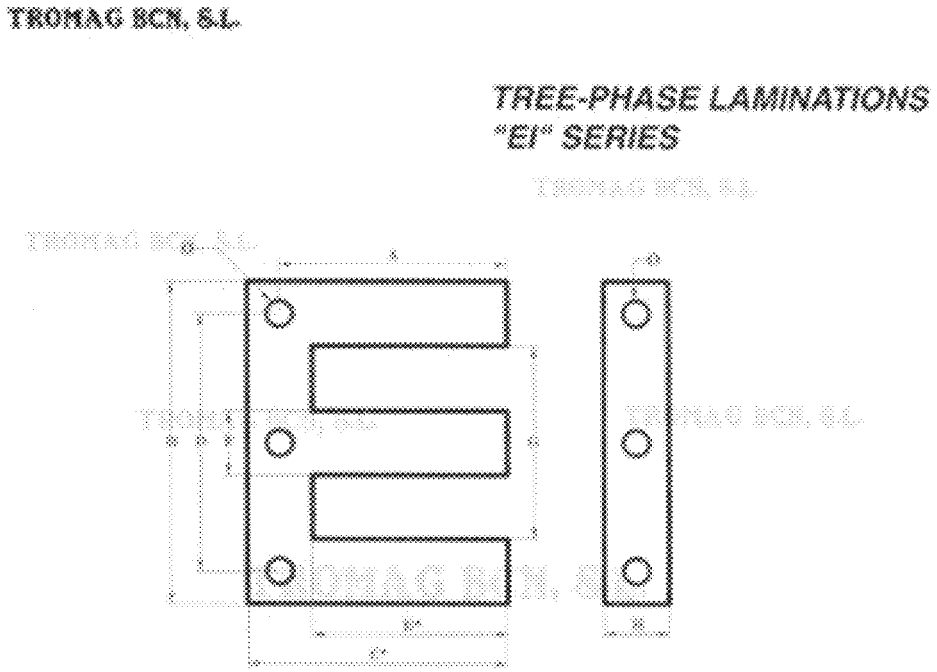
Figure 3. Prior Art
Figure 4:
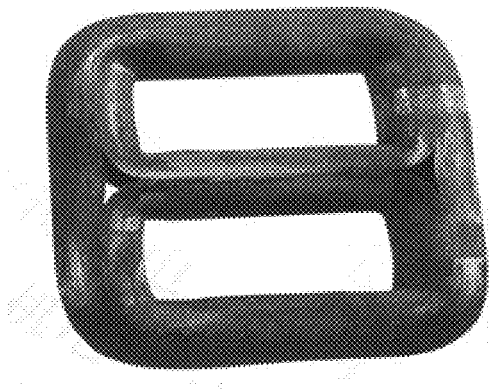
Figure 4. Prior Art
Figure 5:
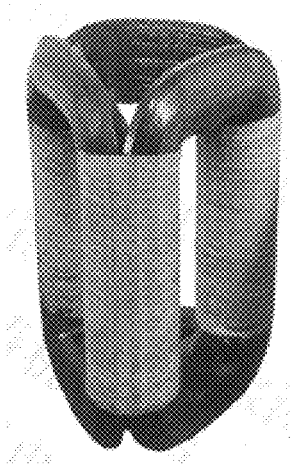
Figure 5. Prior Art
Figure 6:
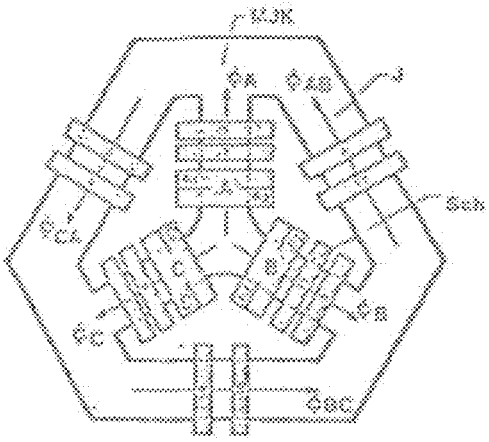
Figure 6. Prior Art
Figure 7:
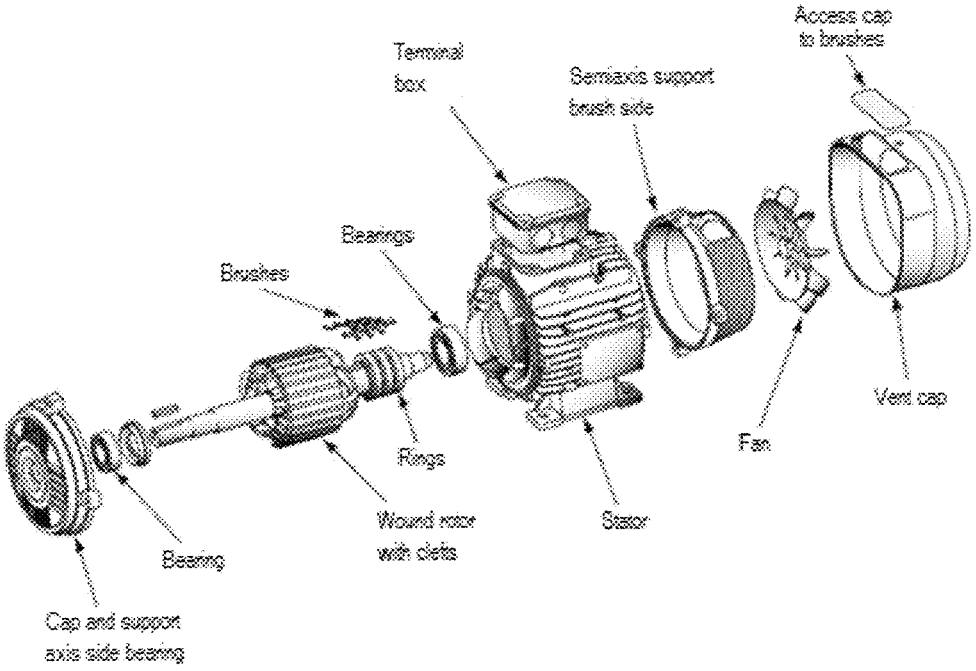
Figure 7. Prior Art
Figure 8:
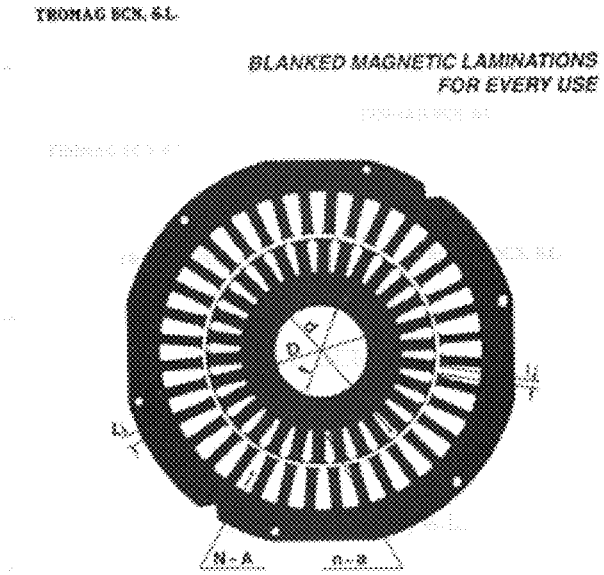
Figure 8. Prior Art

1. Spatial layout at 120° among each other of primary windings and application of three three-phase voltages with a 120° gap among each other in time, enables that three magnetizing currents generate three magnetic fluxes of the same maximum value, with a 120° gap among each other. These three magnetic fluxes, when interacting and according to Ferraris Method, generate a single magnetic flux of constant value that rotates in the space at a speed established by the frequency of three-phase source of voltage. The value of this constant flux is 3/2 times the maximum value of individual fluxes generated by each primary winding. The practical consequence of this ratio is that, for a same power transmission, 1/3 less ferromagnetic material shall be needed compared with the conventional transformers, with a subsequent ferromagnetic material saving.
2. According to the invention proposed, since less magnetomotive force is required per phase, for a same power transmission around 1/3 less cooper conductors shall be needed, which will enable a cost reduction for usage of copper conductors.
3. According to the invention proposed, since the less ferromagnetic material is used in the core, there will be a 30% reduction approximately, magnetizing or iron losses, for a same power and in comparison to conventional transformers (in the equation of section 2.1.2, $R_{fe}$ and $X_m$ increase the value in relation to a conventional three-phase transformer of the same power and equal voltage ratio).
4. According to the invention proposed, since less copper conductor is used, there will be a reduction in a half approximately in respect of copper losses at full load with conventional transformers of a similar power (r1 and r2 shall be lesser, according to the equation of section 2.1.2).
5. According to the invention proposed, due to weight and volume reductions, manufacturing and transportation costs shall be cut in comparison to the manufacture and transport of conventional transformers of equivalent power.
6. According to the invention proposed, a same central core is used by three primary windings and the three secondary windings, different from transformers shown in FIGS. 1 and 2 wherein we can see that per phase and based on their corresponding primary and secondary windings, a different leg is needed for each phase.
7. Symmetrical form in which the core is manufactured and windings are displayed in the proposed invention is about more symmetry that that of the leg cores shown in FIGS. 1 and 2 of the prior art, where we can see that the central leg is shorter than two side legs therefore there is no full symmetry between the three phases.
8. Symmetrical form in which the core is manufactured and windings are displayed in the proposed invention is better than that of the leg core shown in FIG. 1, since it uses a shorter length of ferromagnetic material for a same power to be transmitted.
9. Symmetrical form in which the core is manufactured and windings are displayed in the proposed invention is better than that of the leg cores shown in FIGS. 1 to 5 in respect of heat dissipation and for a same power to be transmitted since cylindrical core occupies a lesser space than a rectangular core.
10. According to the invention proposed, the magnetic flux of the constant module originates a constant value flux density in the module whose orientation varies according to frequency f. In conventional transformers, flux and flux density vary alternatively therefore the invention proposed takes advantage as far as possible of ferromagnetic material.
11. In the two types, second, third and fourth manufacture modes, with primary and secondary windings of each phase in different slots, the winding process is significantly facilitated without losing the abovementioned advantages.
12. In view that three windings share a same magnetic core, this invention is purported, in comparison to three-phase transformers currently manufactured (whose examples are shown below) and for a same transmission power, a material saving of at least a 30% of iron core and copper windings. At the same time, this improves efficiency in relation to transformers currently placed in the market since when operating, for a same transmission power, less energy losses are generated due to parasite currents and by hysteresis and less energy is consumed in copper windings.

13. Likewise, at full load, voltage fall inside drum-type three-phase transformer is lesser (at least 10%) than its traditional equivalent.
14. Furthermore, the symmetrical and cylindrical shape of drum-type three-phase transformer enables a better heat dissipation in comparison to transformers currently placed in the market, which also contributes to reduce the use of dissipation elements.
15. Drum-type three-phase transformers may be manufactured in all ranges of powers currently covered by conventional three-phase transformers and become an interesting and convenient alternative for users of this type of static electrical machine.

8. EXECUTION EXAMPLES

At present, several experimental tests were performed with prototypes shown in FIGS. 20 to 25, with more details shown below.

FIG. 20 shows a frontal figure wherein we can see elements composing the drum-type three-phase transformer. To manufacture this prototype, silicon steel sheets measuring 0.27 mm thick were used. Sheets were manufactured with a laser cutting machine.

Figure 21:
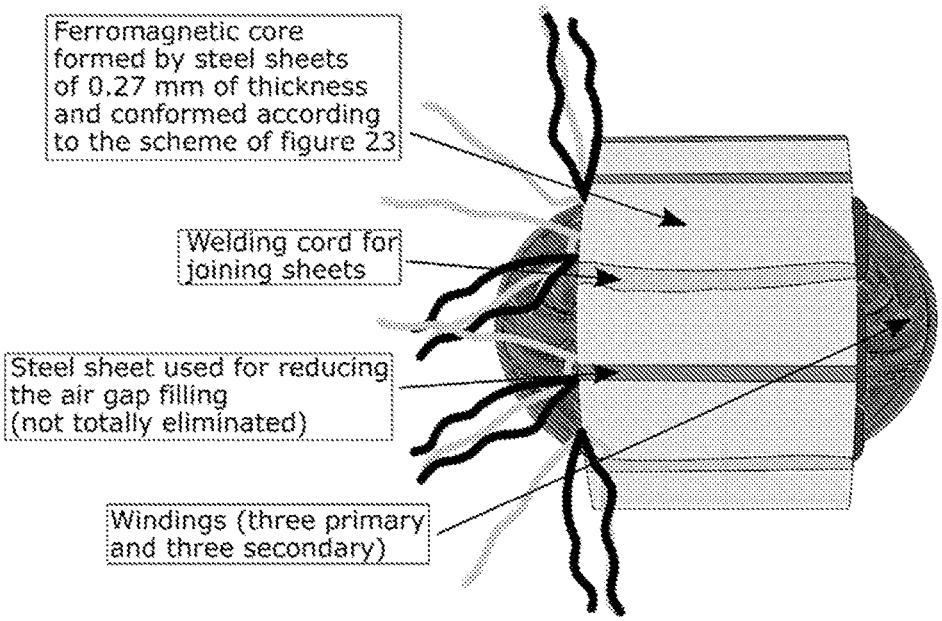

Upon the manufacture of sheets, they were stacked, pressed and welded in a longitudinal manner, as seen in FIG. 21.

Upon conduction of the first tests, it was verified that the theoretically calculated transformation ratio is met, i. e., the voltage ratio between primary and secondary winding is directly proportional to primary and secondary loop ratio.

Likewise, upon conduction of the tests, with load, Ampere ratio is met whereupon the product of secondary winding current by the number of secondary windings is equal to the reaction current in the primary multiplied by the number of secondary loops.

Subsequently, tests were performed on the second type, fourth mode, with good results. FIGS. 22 and 23 show the winding core before the outer ferromagnetic roll.

9. INDUSTRIAL USE

This transformer may be used in any kind of electrical grid and for every kind of power supply transmission, as well as in power stations to increase generator output voltage and electrical stations of the cities, for different electrical voltage reduction stages.

It may be also used in the factories to increase or reduce voltage according to needs of electrical loads of the plant.

The invention claimed is:

1. A three-phase transformer for electrical supply transmission comprising a ferromagnetic, drum-type core where
- The core has holes or windows that extend in parallel to a longitudinal shaft of a drum to place the windings,
- The transformer has three pairs of windings, corresponding to a first, second and third phase,
- Each pair of windings has a primary and a secondary winding Characterized as follows:
- The core is composed of two main components: a central body and an air gap filling system
- The central body is composed of ferromagnetic sheets stacked one against each other, with several spaces or slots to place windings symmetrically distributed on the circle, where the spaces of the central body are trapezoidal in the edge of the circle,
- Windings are symmetrically distributed around the longitudinal shaft of the core and each winding crosses the longitudinal shaft of the core, and
- The air gap filling system consists of several trapezoidal ferromagnetic sheets that fit in the slots of spaces and close the magnetic circuit.

2. The transformer of claim 1 is characterized by the fact that the core comprises three pairs of windows for six windings, and the primary and secondary winding of each phase are placed in the same pair of windows and, where the air gap filling system consists of six trapezoidal sheets that fit in six trapezoidal slots of each circular sheet of the central body and thus close the magnetic circuit.

3. The transformer of claim 1 is characterized by the fact that the core comprises six pairs of windows for six windings, and the primary and secondary windings of each phase are placed in contiguous windows, with a 30° phase change and, where the air gap filling system consists of twelve trapezoidal sheets that fit in twelve trapezoidal slots of each circular sheet of the central body and thus close the magnetic circuit.

4. A three-phase transformer for electrical supply transmission comprising a ferromagnetic, drum-type core where
- The core has holes or windows that extend in parallel to a longitudinal shaft of a drum to place the windings,
- The transformer has three pairs of windings, corresponding to a first, second and third phases,
- Each pair of windings has a primary and a secondary winding Characterized as follows:
- The core is composed of two main components: a central body and an air gap filling system,
- The central body is composed of ferromagnetic sheets stacked one against each other, with several spaces or slots to place windings symmetrically distributed on the circle, where spaces are trapezoidal and communicate with the outside through a slot,
- Windings are symmetrically distributed around the longitudinal shaft of the core and each winding crosses the longitudinal shaft of the core, and
- The air gap filling system consists of several sets of ferromagnetic sheets that extend in parallel to the core shaft of the core and fit in the slots of the spaces once the sheets of the central body are stacked and thus the magnetic circuit is closed.

5. The transformer of claim 2 is characterized by the fact that the core is composed of three pairs of windows for six windings, and the primary and secondary windings of each phase are placed in the same pair of windows and, the air gap filling system consists of six sets of sheets.

6. The transformer of claim 3 is characterized by the fact that the core comprises six pairs of windows for six windings, and the primary and secondary windings of each phase are placed in contiguous windows, with a 30° phase change and, where the air gap filling system consists of twelve sets of sheets.

7. A three-phase transformer for electrical supply transmission comprising a ferromagnetic, drum-type core where
- The core has holes or windows that extend in parallel to a longitudinal shaft of a drum to place the windings,
- The transformer has three pairs of windings, corresponding to a first, second and third phases,
- Each pair of windings has a primary and a secondary winding Characterized as follows:
- The core is composed of two main components: a central body and an air gap filling system The central body is composed of ferromagnetic sheets stacked one against each other, with several spaces to place windings symmetrically distributed on the circle, where the spaces of the central body are trapezoidal in the edge of the circle, Windings are symmetrically distributed around the longitudinal shaft of the core and each winding crosses the longitudinal shaft of the core, and The air gap filling system consists of a ferromagnetic sheet rolled around the central body.

8. The transformer of claim 7 is characterized by the fact that the core comprises three pairs of windows for six windings, and the primary and second windings of each phase are placed in the same pair of windows.

9. The transformer of claim 7 is characterized by the fact that the core comprises six pairs of windows for six windings, and the primary and second windings of each phase are placed in contiguous windows, with a 30° phase change.

10. A three-phase transformer for electrical supply transmission comprising a ferromagnetic drum-type core where The core has holes or windows that extend in parallel to a longitudinal shaft of the drum to place the windings, The transformer has three pairs of windings, corresponding to a first, second and third phases, Each pair of windings has a primary and a secondary winding, Characterized as follows:

The core is composed of two main components: a central body and an air gap filling system The central body is composed of ferromagnetic sheets stacked one against each other, with twelve trapezoidal slots or spaces, Windings are symmetrically distributed around the longitudinal shaft of the core and each winding crosses the longitudinal shaft of the core, The core comprises twelve windows for six windings, and The primary and second windings of each phase are placed in contiguous windows, with a 30° phase change.

11. Transformer of claim 10 containing spaces or slots of the central body that are trapezoidal in the edge of the circle.

12. Transformer of claim 10 or 11 with air gap filling consisting of twelve ferromagnetic elements in the form of trapezoidal sheets that fit in trapezoidal spaces and close the circuit for magnetic flux.

13. Transformer of claim 10 containing spaces or slots of the central core that are trapezoidal and communicate with the outside through a slot.

14. Transformer of claim 10 or 13 where the air gap filling consists of twelve sets of sheets that extend in parallel to the longitudinal shaft and fit in the slots once the sheets of the central body are stacked and close the magnetic circuit.

15. Transformer of claim 10 or 11 where the air gap filling consists of a ferromagnetic sheet rolled around the central body.

16. A three-phase transformer for electrical supply transmission comprising a ferromagnetic drum-type core where The core has holes or windows that extend in parallel to a longitudinal shaft of the drum to place the windings, The transformer has three pairs of windings, corresponding to a first, second and third phases, Each pair of windings has a primary and a secondary winding, Characterized as follows:

The core is composed of two main components: a central body and an air gap filling system, The central body is composed of ferromagnetic sheets stacked one against each other, with six slots or spaces to place the windings, Windings are symmetrically distributed around the longitudinal shaft of the core and each winding crosses the longitudinal shaft of the core, The core comprises three pairs of windows for six windings, The primary and second windings of each phase are placed in the same pair of windows, and the air gap filling consists of six ferromagnetic elements in the form of sheets that fit in the slots or spaces and close the circuit for magnetic flux.

17. Transformer of claim 16 containing slots of the central body that are trapezoidal in the edge of the circle.

18. Transformer of claim 16 where the slots of each of the sheets comprising the central body are trapezoidal and communicate with the outside through a slot.

19. Transformer of claim 16 or 18 where the air gap filling system consists of six sets of sheets that extend in parallel to the longitudinal shaft of the core and fit in the slots once the sheets of the central body are stacked and close the magnetic circuit.

20. Transformer of claim 16 or 17 where the air gap filling consists of a ferromagnetic sheet rolled around the central body.

21. A three-phase transformer for electrical supply transmission comprising a ferromagnetic drum-type core where The core has holes or windows that extend in parallel to a longitudinal shaft of the drum to place the windings and is composed of ferromagnetic sheets stacked one against each other where the sheets have windows instead of slots, The transformer has three pairs of windings, corresponding to a first, second and third phases, Each pair of windings has a primary and a secondary winding, Characterized as follows:

Windings are symmetrically distributed around the longitudinal shaft of the core, Each winding crosses the longitudinal shaft of the core, The core comprises six pairs of windows for six windings, The primary and second windings of each phase are placed in contiguous windows, with a 30° phase change, and an air gap filling consisting of six ferromagnetic elements in the form of sheets that fit in the windows and close the circuit for magnetic flux.

22. A three-phase transformer for electrical supply transmission comprising a ferromagnetic drum-type core where The core has holes or windows that extend in parallel to a longitudinal shaft of the drum to place the windings and is composed of ferromagnetic sheets stacked one against each other, The transformer has three pairs of windings, corresponding to a first, second and third phases, Each pair of windings has a primary and a secondary winding, Characterized as follows:

Windings are symmetrically distributed around the longitudinal shaft of the core, Each winding crosses the longitudinal shaft of the core, The core comprises three pairs of windows for six windings, The primary and second windings of each phase are placed in the same pair of windows, and an air gap filling consisting of six ferromagnetic elements in the form of sheets that fit in the holes or windows and close the circuit for magnetic flux.

23. A three-phase transformer for electrical supply transmission comprising a ferromagnetic drum-type core where The core has holes or windows that extend in parallel to a longitudinal shaft of the drum to place the windings, The transformer has three pairs of windings, corresponding to a first, second and third phases, Each pair of windings has a primary and a secondary winding, Characterized as follows:

Windings are symmetrically distributed around the longitudinal shaft of the core, Each winding crosses the longitudinal shaft of the core, and an air gap filling consisting of six ferromagnetic elements in the form of sheets that fit in the holes or windows and close the circuit for magnetic flux.

* * * * *